US005428516A

United States Patent [19]

Harris

[11] Patent Number: 5,428,516

[45] Date of Patent: Jun. 27, 1995

[54] INTERLOCK FOR MINIATURE LAMP ARRAYS

[76] Inventor: Geoffrey H. Harris, 2954 W. Logan Blvd., Chicago, Ill. 60647

[21] Appl. No.: 202,796

[22] Filed: Feb. 28, 1994

[51] Int. Cl.[6] ..... H01R 33/00

[52] U.S. Cl. ..... 362/226; 362/238; 362/249

[58] Field of Search ..... 362/226, 249, 252, 382, 362/392, 238; 439/616, 617

[56] References Cited

U.S. PATENT DOCUMENTS

| | | | |
|---|---|---|---|
| 804,387 | 11/1905 | Davis | 439/309 X |
| 1,616,654 | 2/1927 | Gammeter | 439/356 |
| 1,905,843 | 4/1933 | Foulke | 439/619 X |
| 2,462,530 | 2/1949 | Miller | 439/356 |
| 3,182,185 | 5/1965 | Ahroni et al. | 362/226 |
| 3,671,923 | 6/1972 | Rieth | 439/385 |
| 4,228,486 | 10/1980 | Matsuya | 362/237 |
| 4,234,915 | 11/1980 | Malinowski et al. | 362/252 |
| 4,241,387 | 12/1980 | Bowers | 362/252 |
| 4,318,158 | 3/1982 | Livermore et al. | 362/29 |
| 4,471,414 | 9/1984 | Savage, Jr. | 362/226 |
| 4,599,682 | 7/1986 | Stephens | 362/103 |
| 4,603,278 | 7/1986 | Devir et al. | 313/318 |
| 4,647,132 | 3/1987 | Mikola | 439/345 |
| 4,679,126 | 7/1987 | Van Sickler | 362/226 |
| 4,943,899 | 7/1990 | Tseng | 362/226 |
| 4,970,632 | 11/1990 | Tseng | 362/226 |
| 5,001,615 | 3/1991 | Stefanelli | 362/226 |

FOREIGN PATENT DOCUMENTS

| | | |
|---|---|---|
| 2217179 | 2/1972 | Germany . |
| 464547 | 2/1971 | Japan . |
| 53-17030 | 8/1979 | Japan . |
| 6220282 | 2/1973 | Taiwan . |
| 1055631 | 7/1967 | United Kingdom . |
| 1370583 | 2/1972 | United Kingdom . |
| 2105531 | 3/1983 | United Kingdom . |

*Primary Examiner*—Stephen F. Husar

*Attorney, Agent, or Firm*—Lockwood, Alex, FitzGibbon & Cummings

[57] ABSTRACT

A decorative light string for miniature lights and the like having an improved interlock is described. The interlock includes a tongue member affixed to the lampholder of each miniature light within the light string and, a complementary lug member is affixed to the housing of the associated lamp socket. The tongue member includes an aperture to receive the lug member therein and, the tongue member and lug are positioned to achieve an interlock whenever the lampholder is positioned within its associated socket.

16 Claims, 2 Drawing Sheets

INTERLOCK FOR MINIATURE LAMP ARRAYS

BACKGROUND

The present invention relates to decorative light strings such as Christmas tree lights and the like having an improved interlock between the lampholders and their associated sockets within the string.

Decorative miniature lights such as miniature Christmas lights are assembled into light strings and, the typical arrangement has the lights connected in a series circuit. A series of lamps are disposed within individual lampholders which are then inserted within complementary electrical sockets. The lampholders must be securely retained within the socket in order for the serially connected decorative light string to remain operative.

A common problem associated with serially connected string sets is the failure of the light string when one of the individual lampholders comes loose or is removed from its electrical socket during handling or use. Each lampholder is normally configured to be received telescopically within an elongate lamp base or socket with the socket and the lampholder secured to each other by a friction fit connection. This typical arrangement can render the light string susceptible to failure because the aforementioned friction fit has generally been inadequate and predisposes the lampholder to becoming loosened from its corresponding electrical socket.

Attempts have been made to further secure the lampholder within its electrical socket. In one arrangement, the lampholder and its corresponding socket include a lug and locking element combination. The lug is positioned on the socket member and the locking element extends from the lampholder with a living hinge connecting a free end portion to the housing on the lampholder. An aperture in the free end portion receives a portion of the lug to form a positive interlock between the lug and the locking element. The living hinge, however, represents a weak point in the interlock. Additionally, the interlock between the locking element and the lug can be difficult to manually operate due to the small sizes of those elements.

In another approach, a separate clamping member fits over the lampholder and frictionally engages a structure on the outer housing of the electrical socket member to retain the lampholder within the socket. The requirement for an additional separate locking piece for each lamp/socket combination, however, increases manufacturing expenses as well as the final price of the string set. Additionally, the clamping device for individual lamp/socket combinations can be lost or broken and thereby render those individual lamp/socket pairs without a retention mechanism.

Accordingly, it is an object of the present invention to provide an improved interlock for light strings such as miniature lights, for example.

Another object is to provide an improved interlock which is integral with the lampholder and/or the electrical socket member.

Another object is to provide an improved interlock which is of a fairly rigid and strong construction while permitting same flexure during the interlocking of parts.

These and other objects of the invention will be apparent to those skilled in the art on a closer examination of the remainder of the disclosure including the summary of the invention, the detailed description of the preferred embodiments and the appended claims.

SUMMARY OF THE INVENTION

The present invention achieves the aforementioned objects and overcomes the shortcomings of the prior art by providing an improved novel interlock for miniature lights such as Christmas tree lights and the like. The invention includes a tongue member integrally affixed to the lampholder and a complementary lug member affixed to the housing of the lamp socket. The tongue member and the lug are configured to cooperate to form an interlock between the lampholder and its associated socket. The interlock of the invention enhances the friction fit or interference fit between the lampholder and its socket. Both the tongue and the lampholder are fairly rigidly constructed while also allowing for some flexing of one or both of the members during the locking and unlocking thereof.

In one embodiment, the tongue member is L-shaped and is affixed to the collar of the lampholder with a first portion extending outwardly from the base of the lampholder and a second portion extending downwardly from the first portion. The L-shaped tongue member is provided with a slot that is dimensioned to receive the lug member therein when the lampholder is coaxially and telescopically received within the socket. The lug member is affixed to the socket housing and both the tongue member and the lug member are configured to achieve an interlock between the lampholder and the electrical socket by a bayonet action wherein the second portion of the tongue member will flex somewhat and is configured to slidably travel over the lug member when the lampholder is inserted within the socket. The lug member is then received within the slot in the tongue member and, when the lug is so positioned, the tongue member regains its unflexed configuration. The lowermost surface of the lug member provides a stop to prevent the lampholder and tongue member from slipping out of the socket during the normal use of the light string.

Alternate embodiments are also described wherein the tongue member extends outwardly from the lampholder at about a 45° angle. A slotted opening is provided within the tongue member to receive the lug therein. The lug member may be angled outwardly at a complementary 45° angle from the electrical socket housing and either the tongue member or the lug member can be constructed to flex slightly during the interlocking process to allow the lug member to be received within the slotted opening on the tongue.

BRIEF DESCRIPTION OF THE DRAWINGS

In describing the preferred embodiments of the invention, reference will be made to the various drawings in which.

DETAILED DESCRIPTION OF THE PREFERRED EMBODIMENTS

Figure 1:
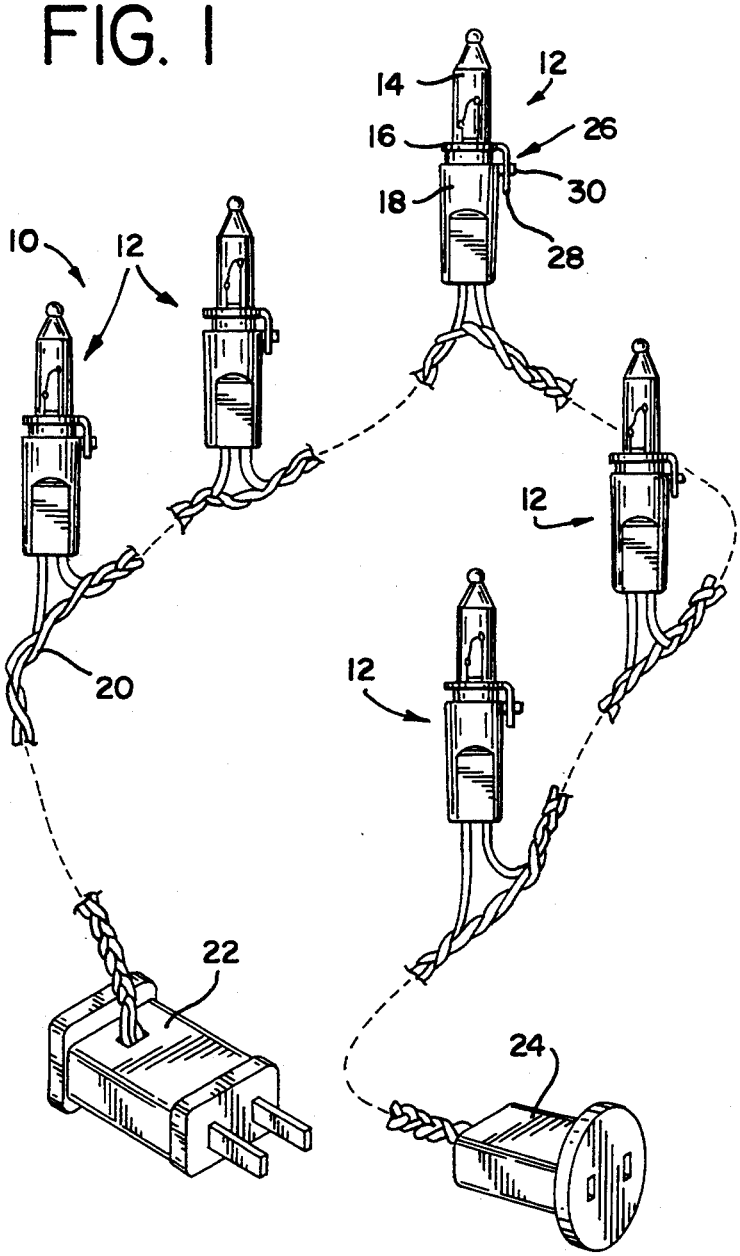
FIG. 1 is a perspective view, in section, of a decorative light string with an improved interlock associated therewith according to the invention.

The preferred embodiments of the invention will now be described in more detail. The invention generally provides an improved interlock for miniature lights such as Christmas tree lights, for example. The invention includes a tongue member integrally affixed to the lampholder of the miniature light and, a complementary lug is affixed to the housing of the associated lamp socket. The tongue member and the lug are configured to cooperate to thereby form an interlock between the lampholder and its associated socket. In describing the specific features of the preferred embodiments, reference is made to the various figures wherein the structural elements are identified with reference numerals and where identical reference numerals indicate identical structures.

Referring now to the drawings, FIG. 1 depicts a decorative miniature light string 10 of the type used during the holidays in the ornamentation of Christmas trees, for example. The string 10 includes a plurality of miniature lamps 12 wherein each lamp 12 includes a bulb 14 nested within a lampholder 16. The lampholder 16 is received coaxially and telescopically within the lamp socket 18 and, the lampholder 16 is secured within the socket 18 by a friction fit connection. The lamps 12 are electrically connected to each other in a series circuit by a power line 20 which, in turn, is connected to a plug 22 at one end of the line 20. An additional electric receptacle 24 can be provided at the other end of the power line 20 to connect the string 10 to another similar string, if desired.

Figure 2:
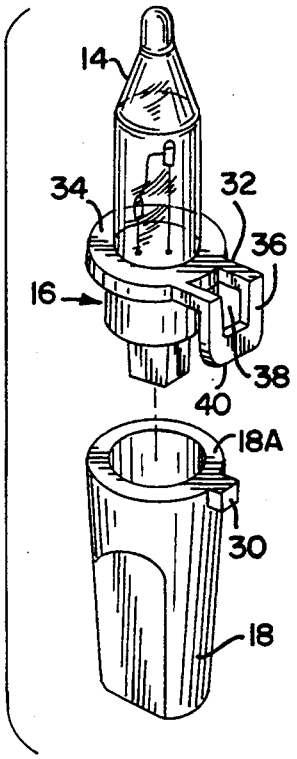
FIG. 2 is an exploded perspective view of a lampholder and its associated electrical socket wherein the lampholder and socket include an improved interlock according to one embodiment of the present invention.
Figure 3:
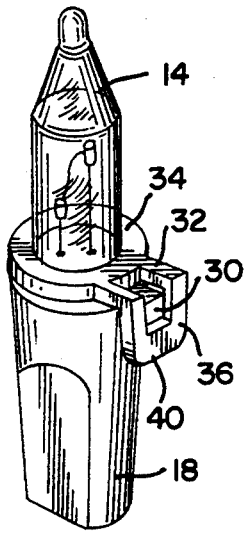
FIG. 3 is a perspective view of the lampholder and socket of FIG. 2 showing the tongue member and the lug member of the interlock assembly in a cooperating and closed condition.

In an important aspect of the present invention, an interlock assembly 26 is provided to reinforce the aforementioned friction fit between the lampholder 16 and the socket 18. The assembly 26 shown in FIGS. 1 through 3 represents a first preferred embodiment of the present invention. The interlock assembly 26 includes a tongue member 28 and a corresponding lug 30. Preferably, the tongue 28 and the lug 30 are both integrally molded with the lampholder 16 and the socket housing 18, respectively. The tongue member 28 is L-shaped with a first portion 32 affixed to the collar 34 of the lampholder 16. The first portion 32 extends laterally outward from the collar 34 to a second portion 36, forming a rigid elbow 35 such that the first portion 32 is perpendicular to the second portion 36, forming a 90° angle at the elbow 35. The second portion 36 is parallel to the longitudinal axis of the lampholder 16. An aperture, generally indicated at 38, is provided within the tongue 28 and, the tongue 28 is also preferably provided with a rounded edge along its distal end 40.

The lug 30 is affixed to the housing of the socket member 18 and, as shown, may be provided as a box-like member (FIG. 2), the uppermost surface 30A of which is flush with the uppermost surface 18A of the socket 18. In this arrangement of parts, the lampholder 16 is coaxially and telescopically received within the socket 18 with the tongue 28 and the lug 30 operatively aligned. When the lampholder 16 is inserted within the socket 18, the rounded distal end 40 of the tongue 28 will contact the uppermost surface of the lug 30, deflecting the second portion 36 of the tongue member 28 so that the second portion 36 slides over the lug member 30 as the lampholder 16 is advanced into the socket 16. The beveled or rounded edge 40 on the tongue 28 may be provided to enhance the ability of the tongue 28 to travel over the lug 30, although the invention is not limited in any way by the inclusion of this feature. The second portion 36 of the tongue member 28 regains its unflexed configuration after clearing the lug member 30 so that the lug 30 is nested within the aperture 38, substantially as shown in FIG. 3. In this manner, a positive and improved interlock is formed between the tongue member 28 and the lug 30.

The aforementioned interlock can be released by a reversal of the above-described procedure. The tongue 28 is manufactured to be somewhat flexible to the extent the second portion 36 should be capable of being flexed slightly away from the housing of the socket 18 to release the lug 30 from within the aperture 38 and thereby free the lampholder 16 from the socket 18.

Figure 6:
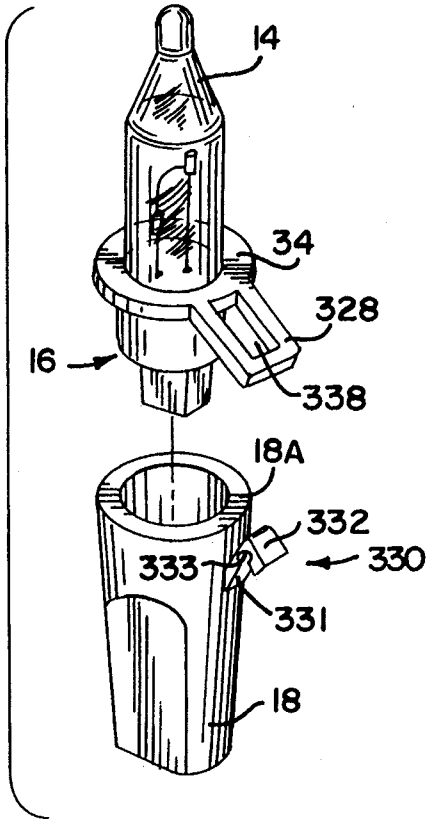
FIG. 6 is a perspective view of a lampholder and its associated electrical socket and including an improved interlock assembly according to still another preferred embodiment of the present invention.
Figure 5:
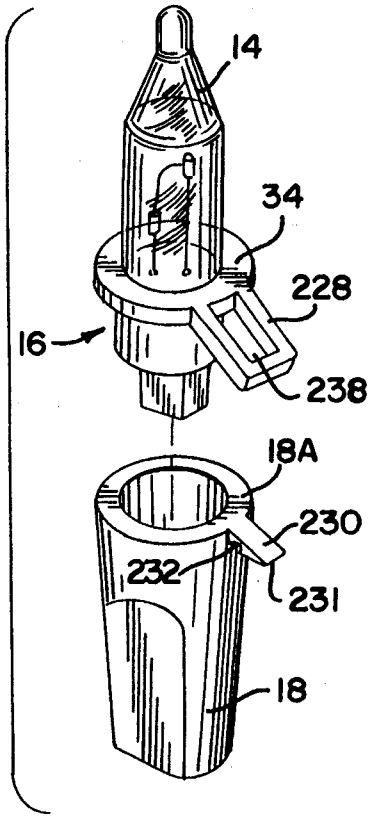
FIG. 5 is a perspective view of a lampholder and its associated electrical socket and including an improved interlock assembly according to yet another preferred embodiment of the present invention.
Figure 4:
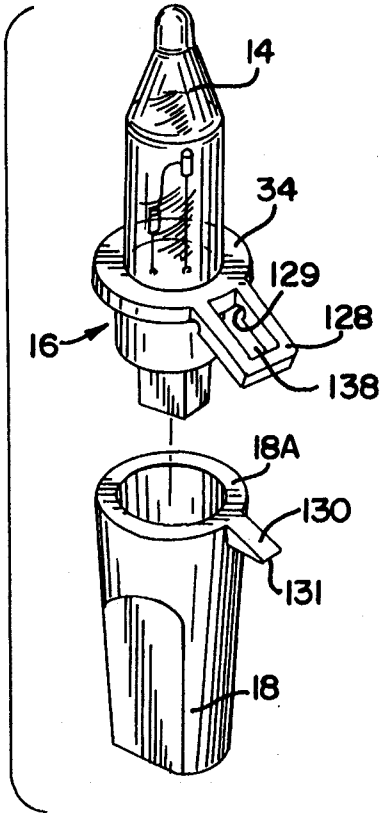
FIG. 4 is a perspective view of a lampholder and its associated electrical socket and including an improved interlock assembly according to another preferred embodiment of the present invention.

Some modifications to the interlock assembly are also contemplated within the scope of the invention. For example, the remaining FIGS. 4, 5 and 6 illustrate additional preferred embodiments of the invention. In referring now to these alternate embodiments, structural features common to the above-described embodiment of FIGS. 1–3 are indicated in the drawings with identical reference numerals and are not discussed further. Only the differences between the various embodiments are described below.

Referring now to FIG. 4, a second preferred embodiment of the invention is shown. In this embodiment, the tongue member 128 again is integrally molded with and affixed to the collar 34 of the lampholder 16. The tongue 128 extends away from the collar 34 at about a 45° angle with respect to the longitudinal axis of the lampholder 16. The tongue 130 is provided with a rectangular slotted opening 138 and, preferably, the tongue is manufactured with sufficient flexibility by, for example, providing an area 129 of slightly decreased material thickness. The tongue 128 will flex along the area 129 to thereby permit the tongue to be rotated upward (e.g. toward the lamp 12) to a maximum angle of about 90° with respect to the longitudinal axis of the lampholder 16 when pushed by the lug 130, as described below, whenever the lampholder 16 is inserted within the socket 18. The tongue 128, and the lampholder 16, are preferably made of a material having form memory whereby the tongue 128 will again return to its aforementioned 45° orientation when the external pressure applied to the tongue 128 is released.

The socket 18 is provided with an integrally molded lug 130. Protruding outwardly and with a downward slope, thereby forming an acute angle of approximately 45° with respect to the longitudinal axis of the socket 18. The lug 130 may be provided with a slightly tapered configuration as shown in FIG. 4 and is of a length which is sufficient to be matingly received within the aperture 138 when the lampholder 16 is inserted within the socket 18. The lug 130 is positioned on the socket 18 to force the tongue 128 to rotate slightly upward, thereby positioning the tongue so that the end 131 of the lug 130 is received within the aperture 138.

Referring now to FIG. 5, a third preferred embodiment of the invention is shown. The embodiment shown in FIG. 5 includes a tongue member 228 extending from the collar 34 of the socket 16. Again, the tongue member 228 is provided with an aperture 238 to receive the lug member 230 therein to form an interlock in accordance with the principles of the present invention. The lug 230 extends from to the uppermost surface 18A of the socket 18. The construction of the tongue 228 and the lug 230 is similar to the embodiment of FIG. 4. However, in the embodiment of FIG. 5, the lug member 230 (rather than the tongue) is manufactured with an area 232 of slightly decreased material thickness to provide a certain amount of flexibility so that the lug 230 can bend downwardly to bring its distal end 231 closer to the housing of the socket member 18 when the lampholder 16 is being inserted within the socket. In this arrangement, the tongue member 228 will push the lug 230 downwardly during the insertion of the lampholder 16 into the socket 18. The lug 18 will bend along the area 232 until the end portion of the lug 230 fits within the aperture 238 to form the interlock, in accordance with the invention.

Referring now to FIG. 6, a fourth preferred embodiment is shown and will now be described. The tongue member 328 extends outwardly from the collar 34 of the lampholder 16 in the same manner as the tongue member 228 of the above described third preferred embodiment. An aperture 338 is provided in the tongue member 328 for receiving the lug 330 therein. The lug member 330 extends from an approximate mid-point on the outer housing of the socket 18 and is angled upwardly or toward the surface 18A of the socket 18. The lug 330 is angled outwardly and includes a first portion 331 extending from the housing of the socket 18 to a second portion 332. The second portion 332 acts as a latch to achieve an interlock between the lug 330 and the tongue member 328 when the lug 330 is received within the aperture 338. An area of decreased thickness 333 is provided at the intersection of first and second portions 331, 332 to allow for flexing of the first portion 331 during the interlocking of the tongue 328 and lug 330.

As mentioned, the tongue members and lugs of the various embodiments of the invention are preferably integrally molded with their respective lampholders 16 and sockets 18. However, the invention is not to be so limited. It is contemplated that the tongue members and/or lug members of the above-described embodiments could be affixed to the lampholders 16 and sockets 18 by other means known to those skilled in the art such as by the use of an adhesive, a hot melt adhesive, a silicone adhesive, a primer, a coupling agent, thermal bonding, combinations thereof and the like. While the various preferred embodiments of the invention have been discussed in some detail above, those skilled in the art will appreciate that various changes and modifications to the various embodiments can be made without departing from the true spirit and scope of the invention, as defined in the following claims.

I claim:

1. A decorative light string having an interlock assembly, comprising:

a plurality of lamps, each said lamp having a bulb associated with a lampholder and each said lampholder configured to be frictionally retained within a socket, said lamps electrically connected to one another along a power line, said power line including a plug member to connect said power line to an electrical power supply;

a tongue member affixed to each of said lampholders and extending outwardly therefrom, said tongue member having an aperture therein;

a lug member affixed to and extending from each of said sockets and dimensioned to be received within said aperture in said tongue member; and said tongue member positioned on said lampholder to receive said lug member within said aperture to provide an interlock therebetween without requiring manual movement of either said tongue member or said lug member other than that required to achieve a frictional fit between said lampholder and said socket.

2. The decorative light string as defined in claim 1 wherein said tongue member includes a first portion extending from said lampholder and substantially perpendicular to the longitudinal axis thereof, and a second portion substantially perpendicular to said first portion and substantially parallel to the longitudinal axis of said lampholder, said second portion extending from said first portion.

3. The decorative light string as defined in claim 2 wherein said second portion terminates in a rounded or beveled edge, said edge dimensioned to slide over said lug member to position said lug member within said aperture when said lampholder is inserted within said socket.

4. The decorative light string as defined in claim 1 wherein said lug member is a box shaped member affixed to said socket and dimensioned to be received within said aperture to thereby form an interlock between said lug member and said tongue member.

5. The decorative light string as defined in claim 1 wherein said tongue member extends outwardly from said lampholder and is configured at about a 45° angle with respect to the longitudinal axis of said lampholder.

6. The decorative light string as defined in claim 5 wherein said tongue member is manufactured to move within an arc between about 45° and about 90° with respect to the longitudinal axis of said lampholder.

7. The decorative light string as defined in claim 5 wherein said lug member extends from said socket member at about a 45° angle with respect to the longitudinal axis of said socket, said lug member being configured to nest within said aperture when said lampholder is retained within said socket.

8. The decorative light string as defined in claim 5 wherein said lug member extends from said socket member and toward said lampholder at about a 45° angle with respect to the longitudinal axis of said socket, said lug member having a first portion extending from said socket and a second portion applied to and extending from said first portion, said second portion shorter than said first portion and configured to be received within said aperture when said lampholder is received within said socket.

9. A decorative light string having an interlock assembly, comprising:

a plurality of lamps, each said lamp having a bulb associated with a lampholder and each said lampholder configured to be frictionally retained within a socket, said lamps electrically connected to one another along a power line having a plug member to connect said power line to an electrical power supply;

a tongue member affixed to each of said lampholders, said tongue member having a first portion extending from said lampholder substantially perpendicular to the longitudinal axis of said lampholder, and a second portion perpendicular to said first portion and substantially parallel to the longitudinal axis of said lampholder, said second portion affixed to and extending from said first portion;

an aperture within said tongue member; and a lug member affixed to said socket and dimensioned to be received within said aperture to provide an interlock therebetween when said lampholder is retained within said socket.

10. The decorative light string as defined in claim 9 wherein said second portion of said tongue member extends from said first portion and terminates in a rounded or beveled edge, said edge dimensioned to slide over said lug member to position said lug member within said aperture when said lampholder is received within said socket.

11. The decorative light string as defined in claim 9 wherein said tongue member and said lug member are integrally molded with said lampholder and said socket, respectively.

12. The decorative light string as defined in claim 9 wherein said tongue member and said lug are affixed, respectively, to said lampholder and said socket by an adhesive, a hot melt adhesive, a silicone adhesive, a primer, a coupling agent, thermobonding and combinations thereof.

13. The decorative light string as defined in claim 9 wherein said lug member terminates in a rounded or beveled edge dimensioned to slide over said lug member to position said lug member within said aperture when said lampholder is inserted within said socket.

14. A decorative light string having an interlock assembly, comprising:

A plurality of lamps, each said lamp having a bulb associated with a lampholder and each said lampholder configured to be frictionally retained within a socket, said lamps electrically connected to one another along a power line including a plug member to connect said power line to an electrical power supply;

a tongue member affixed to and extending from each said lampholder at about a 45° angle with respect to the longitudinal axis of said lampholder;

an aperture extending through said tongue member; and a lug member affixed to and extending from each of said sockets and dimensioned to be received within said aperture to thereby provide an interlock between said lampholder and said socket.

15. The decorative light string as defined in claim 14 wherein said lug member extends from said socket member at about a 45° angle with respect to the longitudinal axis of said socket, said lug member configured to nest within said aperture when said lampholder is retained in said socket.

16. The decorative light string as defined in claim 14 wherein said lug member extends from said socket member toward said lampholder at about a 45° angle with respect to the longitudinal axis of said socket, said lug member having a first portion extending from said socket and a second portion affixed to and extending from said first portion, said second portion shorter than said first portion and configured to be received within said aperture when said lampholder is retained within said socket.

* * * * *